United States Patent [19]

Bertram

[11] Patent Number: 4,828,574

[45] Date of Patent: May 9, 1989

[54] PROCESS FOR PRODUCING AN ADDITIVE FOR LUBRICANTS, AS WELL AS FOR AQUEOUS HEATING MEDIUM AND FUEL SYSTEMS, AS WELL AS THE SPECIAL USE POSSIBILITIES THEREOF

[76] Inventor: Kurt Bertram, Dohnser Weg 5, Alfeld/Leine D-3220, Fed. Rep. of Germany

[21] Appl. No.: 116,720

[22] PCT Filed: Jan. 30, 1987

[86] PCT No.: PCT/EP87/00044

§ 371 Date: Sep. 15, 1987

§ 102(e) Date: Sep. 15, 1987

[87] PCT Pub. No.: WO87/04717

PCT Pub. Date: Aug. 13, 1987

[30] Foreign Application Priority Data

Feb. 3, 1986 [DE] Fed. Rep. of Germany ..... 3603207

[51] Int. Cl.[4] ..... C10L 1/18

[52] U.S. Cl. ..... 44/51; 44/53; 44/56; 44/60; 44/63; 44/78

[58] Field of Search ..... 44/60, 51

[56] References Cited

U.S. PATENT DOCUMENTS

| | | | |
|---|---|---|---|
| 1,926,304 | 2/1928 | Pawlikowski | 44/51 |
| 4,115,313 | 9/1978 | Lyon et al. | 44/51 |
| 4,153,421 | 5/1979 | Marlin | 44/51 |
| 4,347,061 | 8/1982 | Madsen et al. | 44/51 |
| 4,415,338 | 11/1983 | Schick et al. | 44/51 |
| 4,425,136 | 1/1984 | Pearson et al. | 44/51 |
| 4,652,271 | 3/1987 | von Rybinski et al. | 44/51 |

OTHER PUBLICATIONS

Junk & Pancoast-Handbook of Sugars-1973-Chapter 5-pp. 50-66.

*Primary Examiner*—William R. Dixon, Jr.
*Assistant Examiner*—Ellen M. McAvoy
*Attorney, Agent, or Firm*—Helfgott & Karas

[57] ABSTRACT

A process for producing an additive for lubricants and for aqueous fuel mixtures and heating media is described, in which an alkaline aqueous solution of an inverted cane sugar as the main component and containing a hydrocarbon and an alcohol is heated and then cooled. Use is made of inverted cane sugar with a degree of inversion of approximately 50 to 80% and is heated to approximately 75° to 100° C. until a red shade forms. The additive obtained in this way, mixed with alcohol, water and gasoline, can be used as an excellent fuel and as a substitute for normal gasoline and even superfuel. A corresponding mixture can also be used as a heating medium. The characteristics of lubricants can be improved by incorporating this additive. In addition, the effectiveness of air filters of motor vehicles and internal combustion systems can be improved by impregnating the filter material with the described additive.

6 Claims, No Drawings

PROCESS FOR PRODUCING AN ADDITIVE FOR LUBRICANTS, AS WELL AS FOR AQUEOUS HEATING MEDIUM AND FUEL SYSTEMS, AS WELL AS THE SPECIAL USE POSSIBILITIES THEREOF

TECHNICAL FIELD

The invention relates to a process for producing an additive for lubricants, as well as for aqueous fuel mixtures and heating media, in which an alkaline aqueous solution of an inverted cane sugar as the main component with a content of a hydrocarbon and an alcohol is heated and then cooled, the aforementioned use possibilities and the use as an impregnating material for air filters of motor vehicles and random combustion systems.

PRIOR ART

The process of the aforementioned type is known from DE-OS No. 3,205,594. According to the specific details of the latter a mixture of 50% caustic soda solution, petroleum, acetic acid, glycerol, an ethanol/-propanol mixture and a main mass constituted by an inverted liquid sugar, particularly based on cane sugar, is kept for 10 minutes at a temperature of approximately 60° to 65° C. Following cooling, an agent is formed which, added to mixtures of water, alcohol and gasoline (e.g. in a volume ratio of 1:5:4) in a quantity of a few parts per thousand, yields a liquid, which can be used in random combustion systems, as well as in internal combustion engines of motor vehicles. Although this known process leads to extremely advantageous results, it requires a careful matching of the aforementioned components. Thus, particularly favourable results are obtained with an additive prepared in the following way. Firstly a mixture of 20 to 45% by weight of 50% caustic soda solution, 3 to 15% by weight of petroleum, 3 to 15% by weight of 5% acetic acid, 25 to 80% by weight of glycerol and 20 to 45% by weight of a mixture of ethanol and propanol is prepared. This mixture is subsequently mixed with 10 times the quantity of a 75% aqueous inverted liquid sugar (cane sugar). This is heated to the effective additive of aqueous fuels, etc. in the described manner. It is considered possible to increase the effectiveness of such an additive by adding traces of calcium sulphate hemihydrate ($CaSO_4 \frac{1}{2} H_2O$).

DISCLOSURE OF THE INVENTION

The problem of the invention was to so improve the aforementioned process that a simple and more flexible production of the sought process product is made possible.

According to the invention this problem is solved in that use is made of cane sugar with a degree of inversion of approximately 50 to 80%, particularly approximately 55 to 75% and is heated to approximately 75° to 100° C. until a red shade forms.

Thus, the essence of the invention is that use is not made of completely inverted cane sugar. Use is in fact made of a degree of inversion of approximately 50 to 80%, particularly approximately 55 to 75% and in preferred manner approximately 60 to 70%, whilst a level of approximately 66% in especially preferred manner leads to the desired results. With respect to the choice of the special inverted cane sugar, the invention constitutes a selection invention.

It is vital in conjunction with this selection to continue the heating of the starting mixture until a red shade has formed. This important fact can also not be gathered from prior art. It is advantageous that this red shade is obtained as quickly as possible, which can be achieved by heating the starting mixture to a temperature of more than approximately 75° C., preferably more than approximately 80° C. and especially more than 90° C. Particularly favourable characteristics are obtained with respect to the process product if it is kept for some time roughly at boiling temperature and in particular approximately 100° C., in order to bring about the indicated red shade. A temperature of 100° C. should not be exceeded. Following heating, cooling takes place to ambient temperature.

The starting material for the inventively sought product is always a concentrated aqueous solution of cane sugar with the indicated degree of conversion. The concentration of this cane sugar is advantageously at least 50% by weight and in particular close to the degree of saturation. Particularly favourable results are obtained if the aqueous starting medium contains approximately 60 to 75% by weight of the partly inverted cane sugar. A concentration of 72% by weight has proved to be extremely useful. This solution is now adjusted weakly alkaline by means of organic or inorganic bases, such as caustic soda solution, caustic potash solution and/or calcium hydroxide, or by protolysis of alkaline-acting salts, particularly carboxylates, as well as salts of weak acids with strong bases, such as sodium acetate and sodium carbonate. It has been found that the sought weak alkaline range, particularly a pH-value of approximately 8 to 10 is particularly advantageously kept constant by the buffering action of the addition of alkaline buffering carboxylates, particularly sodium acetate.

Preferably a few parts per thousand of a hydrocarbon, particularly approximately 2 to 25 parts by weight are added to approximately 1000 parts by weight of the aqueous solution of the partly inverted cane sugar. The hydrocarbon can be constituted by different materials and should in particular be a liquid hydrocarbon. There are no significant restrictions to the invention in this connection. It can be constituted by different petroleum fractions of aliphatic and/or aromatic origin. Examples are raw gasoline, petroleum, light gasoline, ligroin, heavy gasoline, illuminating oil, gas oil (diesel or heating oil), cyclic hydrocarbons (naphthenes) and their fractions in the form of cyclopentane and cyclohexane, as well as petroleum fractions which, as regards their composition, occupy a central position between "paraffinic" and "naphthenic" petroleums.

Finally, to the aqueous solution of the partly inverted cane sugar is added a compound having an alcoholic character, particularly a lower primary, secondary or tertiary monohydric or polyhydric alcohol. Methanol, ethanol, propanol, butanol, glycol and glycerol are preferred. These compounds are advantageously added in a quantity that there are approximately 5 to 100 parts by weight thereof for 1000 parts by weight of the solution of the partly inverted cane sugar. The range of approximately 10 to 60 parts by weight is particularly preferred. Especially favourable results are regularly obtained if there are approximately 50 parts by weight of the alcohol, aldehyde and/or ketone for 1000 parts by weight of the liquid sugar. The function of these compounds has not yet been clearly clarified. Possibly they serve as a dispersant. It is necessary for them to be readily soluble in the aqueous solution of the partly inverted cane sugar. This requirement is fulfilled by the aforementioned compounds.

Within the scope of the aforementioned known process, it is also considered advantageous to additionally admix small amounts of gypsum ($CaSO_4 \frac{1}{2} H_2O$). Only traces are required, "traces" being understood to mean quantities of $10^2$ to $10^{-4}$ ppm. However, the addition of gypsum does not improve the special suitability of the hereinafter described flammable aqueous mixtures. In fact it leads to the reduction of small amounts of toxic substances when the aqueous mixtures are burned. At these temperatures gypsum decomposes to calcium oxide and sulphur trioxide. The decomposition products lead to the elimination of undesired toxins during the combustion process.

The product obtained according to the aforementioned inventive process has the interesting property improved compared with the prior art of, together with hydrocarbons, alcohols and water, supplying a flammable or combustible mixture, which can be used as fuel in random combustion systems, particularly in motor vehicle engines. It is added to the mixtures of water, alcohol and gasoline in comparatively small amounts. The water proportion is essentially responsible for deciding whether this mixture is used as "normal gasoline" or as "superfuel". The knocking resistance decreases with increased water proportions. It has been found that a mixture of approximately 1 part by weight water, 5 parts by weight ethanol and 4 parts by weight paraffin, mixed with approximately 0.1 part by weight of the inventive additive (e.g. of 5 g of sodium hydroxide, 5 g of petroleum, 0.001 g of sodium acetate, 38 g of glycerol, 27 g of ethanol and 1000 g of 75% inverted cane sugar—degree of inversion 66%) yields 10 liters of normal fuel or gasoline. This fuel fulfils the requirements made on normal gasoline by DIN 51 600, i.e. its knocking resistance is adequate to permit the use thereof as a fuel in motor vehicles operated with normal gasoline. The above-described product can be converted into a superfuel, if only approximately $\frac{1}{4}$ of the indicated water proportion is used. Such a product is equivalent to a superfuel satisfying the requirements of the above DIN rule. As a function of the operating conditions of different combustion systems for heating oil and the like, the optimum mixture for such purposes can be determined with the aid of simple tests.

It has also been found that the inventive additive also leads to an advantageous improvement of the lubricating properties of lubricants. The term "lubricant" is to be understood in its widest sense. Lubricants are considered to cover in particular those for cutting work, such as cutting and drilling oils, as well as oils for non-cutting work, such as are used in the cold rolling process.

It is particularly surprising that the filtering action of air filters of motor vehicles, as well as combustion systems is significantly improved if the filter materials are impregnated with the inventive additive. This effect can be increased if, over and beyond the above-described measures of the inventive process or in the following way the mixture having the red shade is added in excess water and kept for several days with the exclusion of air at ambient temperature, the resulting product is provided with a small amount of egg yolk, particulary chicken egg yolk (as the albuminous nutrient medium base or nutrient medium for microorganisms) and then stored again for several days at ambient temperature. In a particular case approximately 30 g of the inventive additive was mixed with 4 liters of water. The resulting material was then kept at ambient temperature sealed in airtight manner for 16 days. Microbiological tests revealed that microorganisms formed. Thus, it can be looked upon as a type of nutrient solution. On adding chicken egg yolk to this nutrient solution, microbial growth was further increased. It was found that the biological process was completed after roughly 23 days. Inter alia phosphoproteins could be detected in the material obtained. The resulting material can be used particularly effectively as an impregnating agent for air filters of motor vehicles and combustion systems. The effect is increased by incorporating into said additive a lower alcohol, such as methanol, ethanol, propanol and/or butanol or also glycol or glycerol and there can be two parts of additive for roughly one part of alcohol.

The cause of the successful results obtained by the invention cannot be explained in detail. It is assumed that the cane sugar with the indicated degree of inversion is subject to certain microbiological sequences under the represented process conditions leading to the formation of specific microorganisms. However, these technical standpoints are not vital for performing the invention.

If by using the inventive additive, a fuel is produced, the latter is found to be superior in several respects to the superfuels according to DIN 51 600. This in particular applies in connection with the proportion of environmentally prejudicial pollutants. This is made clear by the comparison of the inventive multicomponent fuel consisting of 200 ml of water, 0.4 g of inventive additive, 3000 ml of isopropyl alcohol and 700 ml of supergasoline (inventive MCF fuel) and normal supergasoline with an octane rating of more than 98%.

Superfuel at 480 r.p.m./CO-value 3.5 vol. %

Inventive MCF fuel CO-value 0.2 vol. % (MCF=multicomponent fuel).

Thus, in the inventive MCF fuel, the CO-value is reduced by approximately 95%. Its further advantage is that it requires no separate agent for increasing the knocking resistance, particularly no lead compounds. If the filters of motor vehicles are treated with the inventive additive, particularly in accordance with the aforementioned further procedure (additional treatment with special proteins), then there is a reduction of the CO-value by approximately $\frac{1}{3}$ in the case of conventional superfuels.

The invention will now be explained in greater detail with the aid of examples.

EXAMPLE 1

An inventive additive is prepared as follows: Mixing and heating of

- 25 g of 50% caustic soda solution
- 5 g of illuminating petroleum (boiling range 150° to 250° C.)
- 5 g of 25% acetic acid
- 30 g of glycerol (DAB VII)
- 25 g of 96% ethanol
- 1 g of calcium sulphate hemihydrate
- 1000 g of 75% saccharose solution (degree of inversion 66%)

(heated for approximately 10 minutes to approximately 100° C. until a red shade is obtained).

2 g of the inventive additive described in the example were mixed with 1 liter of tap water. 3 liters of isopropanol were then mixed with 200 ml of this solution and stirred. The 3.2 liters obtained were then well mixed with 7 liters of superfuel from a Realkauf filling station. The thus prepared fuel mixture of 10.2 1 was then filled into a previously completely emptied tank of a VW box-type delivery van (type 21, 50 hp and 1570 cc cubic capacity) as the test vehicle, which was then driven for 50 km. The travelling behaviour was excellent. There were no differences compared with standard supergasoline as regards the performance.

EXAMPLE 2

The additive described in connection with Example 1 was tested with superfuel using various car types in connection with the CO-value. The tests were carried out with an IR exhaust gas analyzer MHC 220 (manufactured and marketed by Hermann Electronic). During testing no changes were made to the engine settings of the test vehicles. The test vehicles were an Opel Ascona (cubic capacity 1.6 liters and 75 hp) and a Mercedes 200 (94 hp). When testing using the Mercedes 200, in two tests the increase in the effectiveness of air filter by impregnating with the inventive product was established. The following results were obtained:

(1) Opel Ascona (a) normal superfuel 800 r.p.m., CO-value 2.0 vol. %
1600 r.p.m., CO-value 2.0 vol. %
4800 r.p.m., CO-value 3.5 vol. %

(b) measurement with inventive MCF fuel according to example 1

800 r.p.m., CO-value 0.2 vol. %
1600 r.p.m., CO-value 0.5 vol. %
4800 r.p.m., CO-value 0.2 vol. %

Thus, the inventive MCF fuel led to a Co-value reduction by approximately 95%.

(2) Test with Mercedes 200

(a) measurement with normal superfuel (original air filter)

700 r.p.m., CO-value 2.2 vol. %
4500 r.p.m., CO-value 1.2 vol. %

(b) measurement with normal superfuel, in which the filter material was impregnated with the additive described in Example 1

700 r.p.m., CO-value 1.5 vol. %
4500 r.p.m., CO-value 0.8 vol. %

(c) measurement with the inventive MCF fuel (original air filter)

700 r.p.m., CO-value 0.25 vol. %
4500 r.p.m., CO-value 0.20 vol. %

(d) measurement with MCF fuel and an air filter impregnated with the additive according to the invention 700 r.p.m., CO-value 0.20 vol. %
4500 r.p.m., CO-value 0.18 vol. %

The CO-value can be further considerably reduced with the inventive impregnation. Test runs with the individual vehicles revealed that the inventive MCF fuel and the normal superfuel used for comparison purposes were absolutely comparable as regards performance.

I claim:

1. Process for producing an additive for aqueous fuel mixtures, comprising the steps of obtaining a mixture of a composition comprising approximately 1000 parts by weight of an alkaline aqueous solution of partly inverted cane sugar, approximately 2 to 25 parts by weight of hydrocarbon and 5 to 100 parts by weight of alcohol using in said mixture inverted cane sugar with a degree of inversion of approximately 60 to 75%, heating said mixture to approximately 75° to 100° C. up to a formation in said mixture of a red shade, and cooling the mixture.

2. Process according to claim 1, wherein the cane sugar in said mixture has a degree of inversion of approximately 66%.

3. Process according to claim 1, wherein said cooling step takes place at ambient temperature.

4. Process according to claim 1, wherein the mixture obtained having a red shade is added to excess water and stored at ambient temperature for several days whilst excluding air, and wherein a resulting product is provided with a small amount of egg yolk and then stored again for several days at ambient temperature.

5. Use of the product produced according to the process of claim 1, mixed with water, alcohols and petroleum fractions as a fuel for motor vehicles.

6. Additive for fuel systems obtained according to the process of claim 1.

* * * * *